US011110587B2

(12) United States Patent
Chin-Chen

(10) Patent No.: US 11,110,587 B2
(45) Date of Patent: Sep. 7, 2021

(54) PAINTING TOOL STRUCTURE

(71) Applicant: Huang Chin-Chen, Taichung (TW)

(72) Inventor: Huang Chin-Chen, Taichung (TW)

( * ) Notice: Subject to any disclaimer, the term of this patent is extended or adjusted under 35 U.S.C. 154(b) by 387 days.

(21) Appl. No.: 16/221,548

(22) Filed: Dec. 16, 2018

(65) Prior Publication Data

US 2020/0189089 A1 Jun. 18, 2020

(51) Int. Cl.
*B25G 3/28* (2006.01)
*B25G 1/10* (2006.01)
*B05C 17/10* (2006.01)

(52) U.S. Cl.
CPC ..... *B25G 3/28* (2013.01); *B05C 17/10* (2013.01); *B25G 1/102* (2013.01)

(58) Field of Classification Search
CPC ..... B25G 3/28; B05C 17/10
USPC ..... 81/489
See application file for complete search history.

(56) References Cited

U.S. PATENT DOCUMENTS 4,307,481 A * 12/1981 Phares ..... B05C 17/10 15/235.4
9,393,708 B2 * 7/2016 Babaev ..... B21D 53/60
D911,137 S * 2/2021 Ventura ..... D8/45
2014/0123425 A1 * 5/2014 Harper ..... E04F 21/16 15/235.4
2019/0024391 A1 * 1/2019 Huang ..... E04F 21/026

FOREIGN PATENT DOCUMENTS

EP 3263801 A2 * 1/2018 ..... B25G 1/10
FR 2969192 A1 * 6/2012 ..... E04F 21/163
WO WO-2007135247 A1 * 11/2007 ..... E04F 21/06
WO WO-2008142221 A2 * 11/2008 ..... B44D 3/164
WO WO-2013001277 A2 * 1/2013 ..... E04F 21/162

* cited by examiner

*Primary Examiner* — Lee D Wilson
*Assistant Examiner* — Jonathan G Santiago Martinez

(57) ABSTRACT

This invention is an improved painting tool structure, consisting of a body and a knife board. The body comprises a grip part and a bottom plate. The grip part protrudes from the upper surface of one end of the bottom plate, whereas a clamping slot with an opening facing downward is disposed between the grip part and the bottom plate. The bottom plate and the clamping slot form an angle of less than 90 degrees. The knife board comprises a blade part and a connecting part, where the connecting part 22 is obliquely extended upward from one end of the blade part to form an angle of less than 90 degrees, and is to be connected to the clamping slot.

9 Claims, 8 Drawing Sheets

PAINTING TOOL STRUCTURE

BACKGROUND OF THE INVENTION

Technical Field

The present invention is an improved painting tool structure, and is in particular a type of structure in which the blade part and the connecting part forms an angle of less than 90 degrees.

Prior Art

A conventional paint squeegee is used for leveling the surface of a pre-painted wall. In general, a paint squeegee comprises a handle and a blade which is screwed onto the handle.

However, the disadvantage of this type of combination is, when a user needs to replace the blade, an additional tool such as a wrench or a screwdriver is required to remove the screw before the blade can be disassembled and assembled. In addition, after the screw is tightened for a period of time or is tightened repeatedly, the screw is prone to be loose, thereby making it inconvenient to use.

Therefore, the inventor of the present invention has actively carried out researches and improvements for years using his practical experiences in related designs. In addition, the inventor has created and tested physical samples multiple times, thereby improved the shortcomings mentioned above, and eventually completed the present invention.

SUMMARY OF THE INVENTION

To overcome the shortcomings above, the present invention offers an improved painting tool structure, which allows the body and the knife board to connect to each other in a quick and stable manner through the clamping slot and the connecting part.

The present invention is an improved painting tool structure, consisting of:

A body, where it comprises a grip part and a bottom plate; the grip part protrudes from the upper surface of one end of the bottom plate, and a clamping slot with an opening facing downward is disposed between the grip part and the bottom plate. Moreover, the bottom plate and the clamping slot form an angle of less than 90 degrees;

A knife board, where it comprises a blade part and a connecting part; the connecting part is obliquely extended upward from one end of the blade part to form an angle of less than 90 degrees, and the angle between the blade part and the connecting part is generally equal to the angle between the bottom plate and the clamping slot; the connecting part comprises multiple positioning parts, and is to be connected to the clamping slot on the body, while the positioning parts are configured to be engaged with the limiting body so that the knife board is connected to the body.

Therefore, after the connecting part is connected to the clamping slot, the knife board is fixed under the bottom plate of the body, and the blade part partially exposes the body.

The following is a detailed description of specific embodiments and drawings, so that the review committee has a better understanding of the technical features of the present invention.

DETAILED DESCRIPTION

Figure 1:
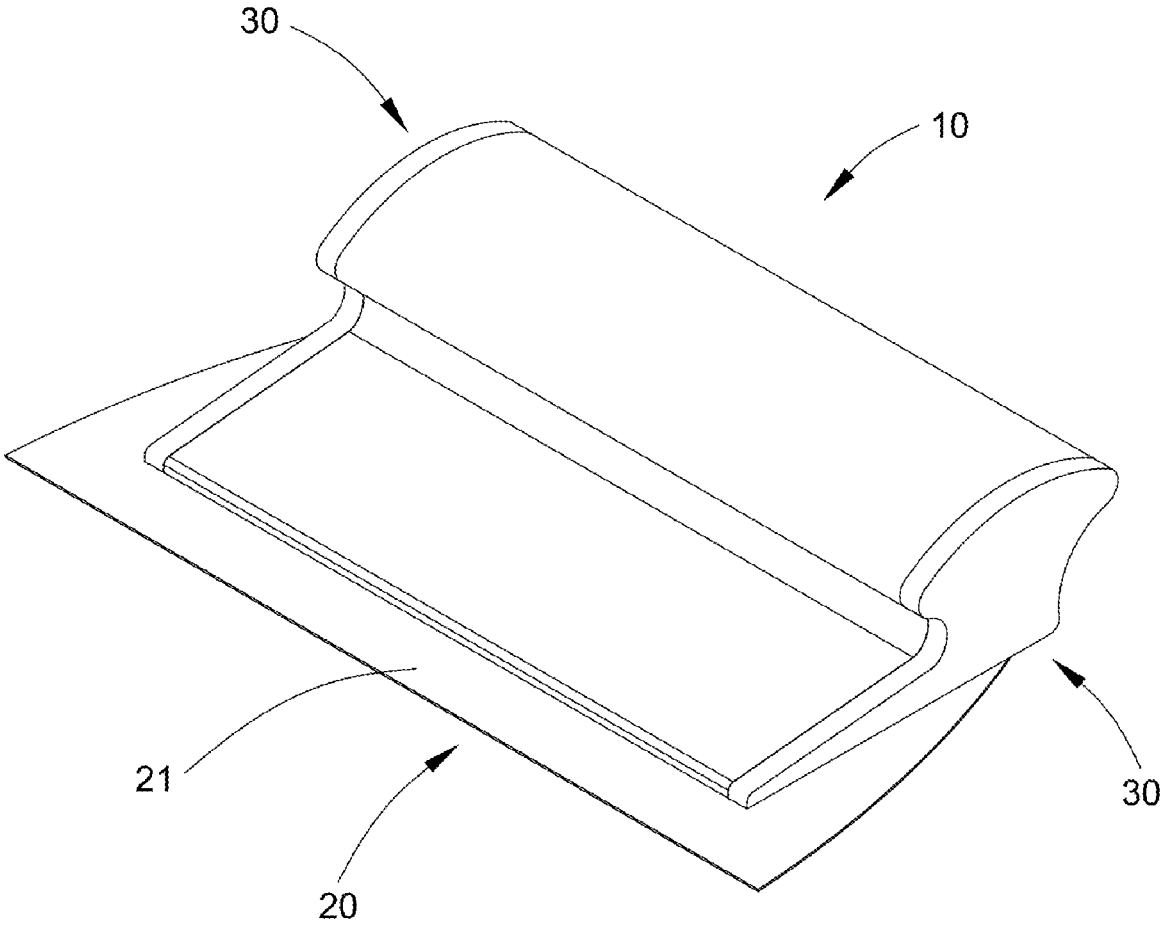
FIG. 1 is a perspective view of the first embodiment in the present invention.
Figure 2:
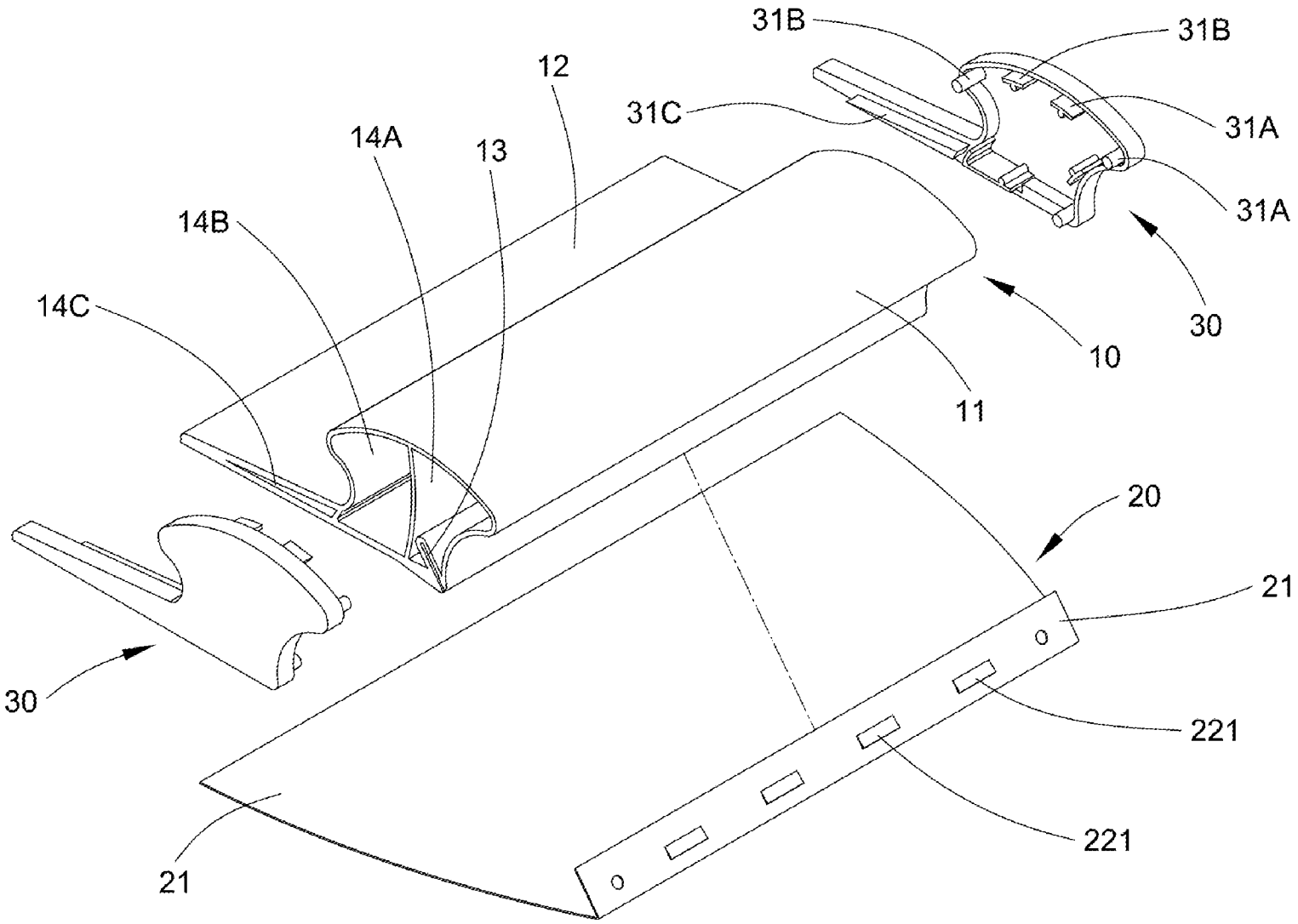
FIG. 2 is an exploded perspective view of the first embodiment of the present invention.
Figure 3:
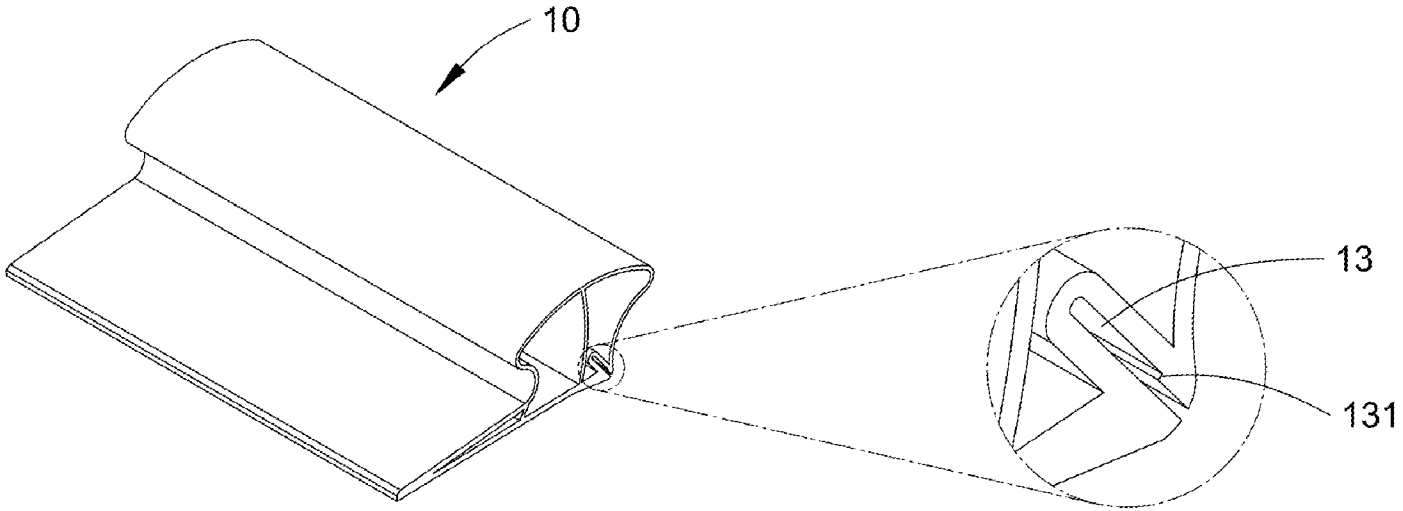
FIG. 3 is a detailed view of a clamping slot in the present invention
Figure 4:
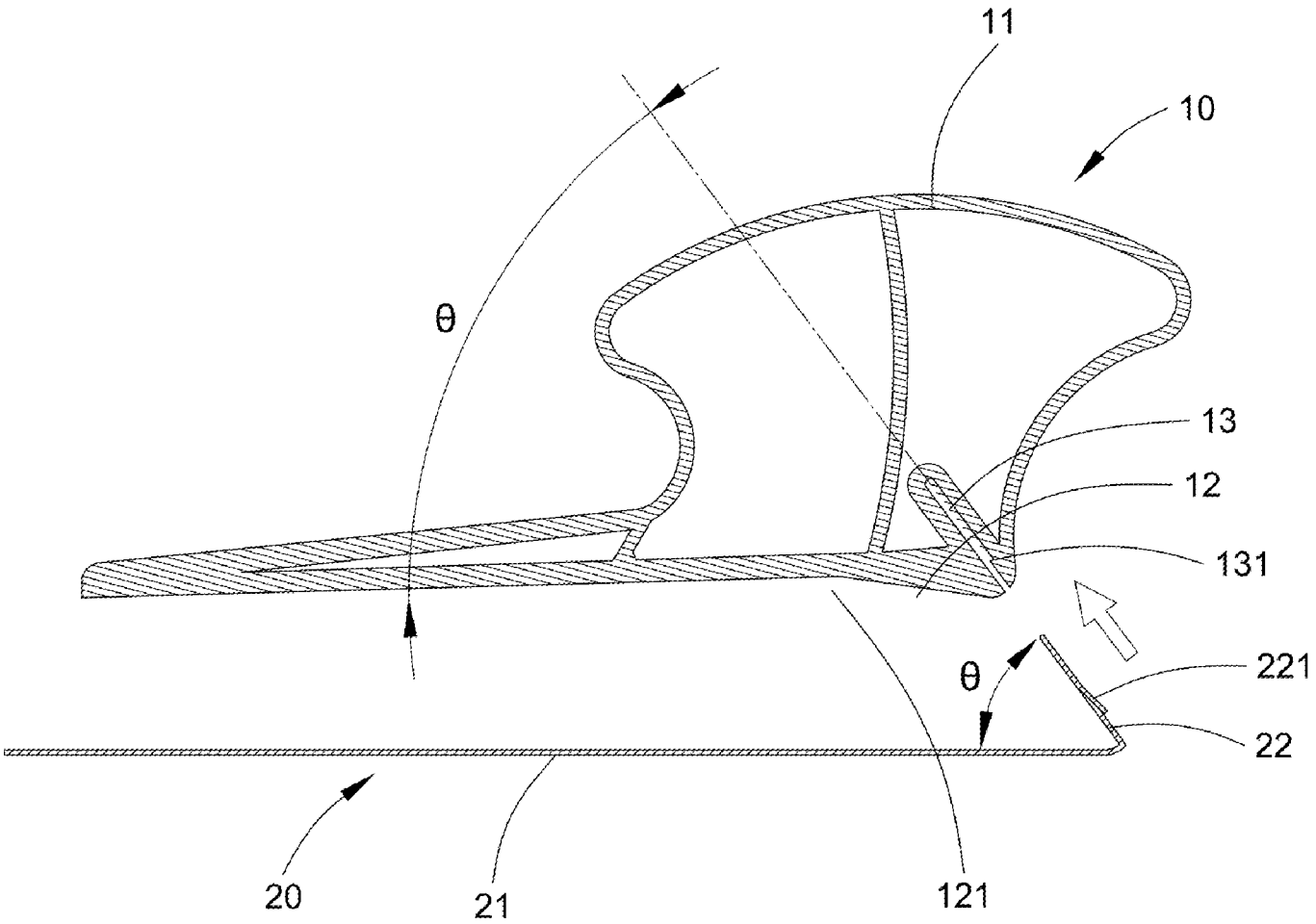
FIG. 4 is a cross-sectional view of a body and a knife board in the present invention
Figure 5:
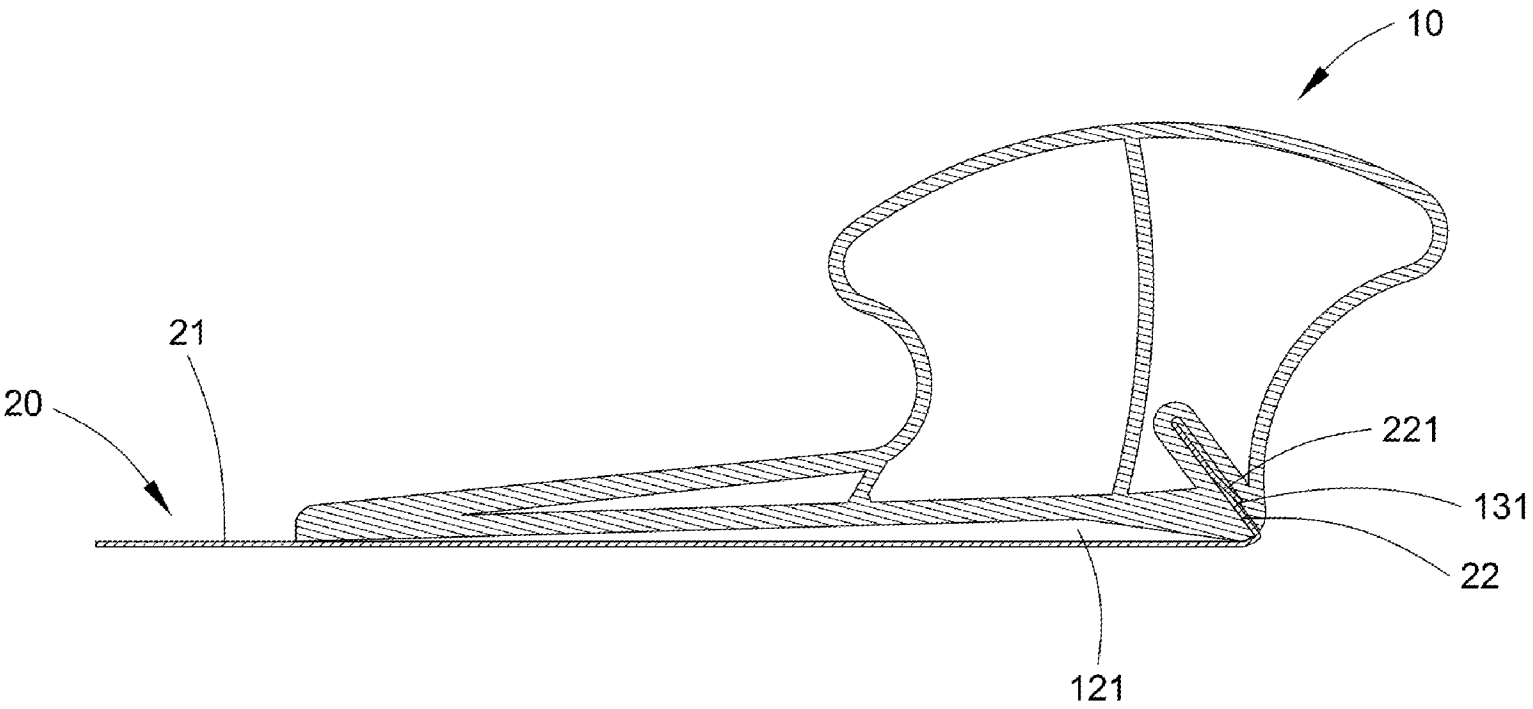
FIG. 5 is a cross-sectional view of a body and a knife board in the present invention after they are connected.
Figure 6:
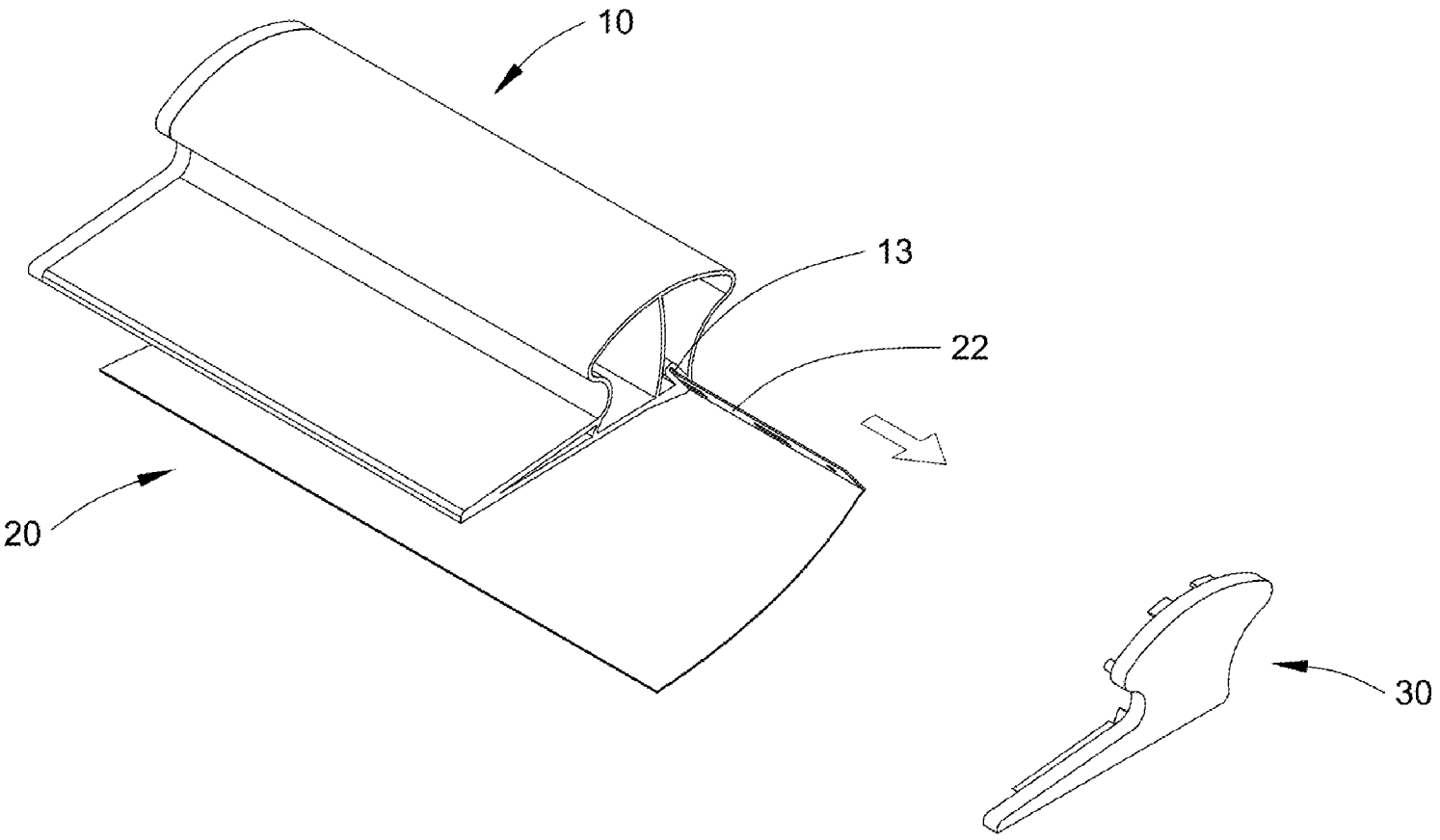
FIG. 6 is a perspective view of the present invention after it is dismantled.
Figure 7:
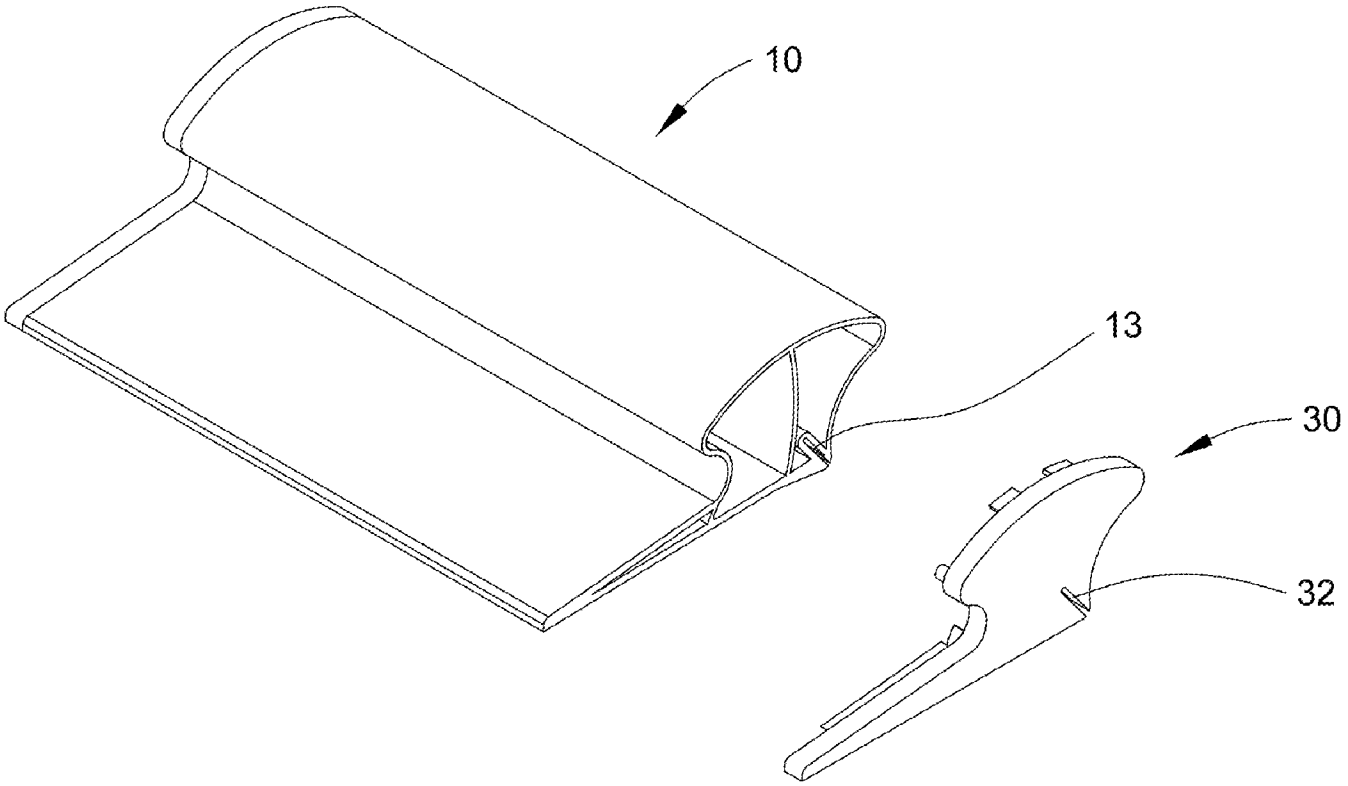
FIG. 7 is an exploded perspective view of a second embodiment of the present invention.
Figure 8:
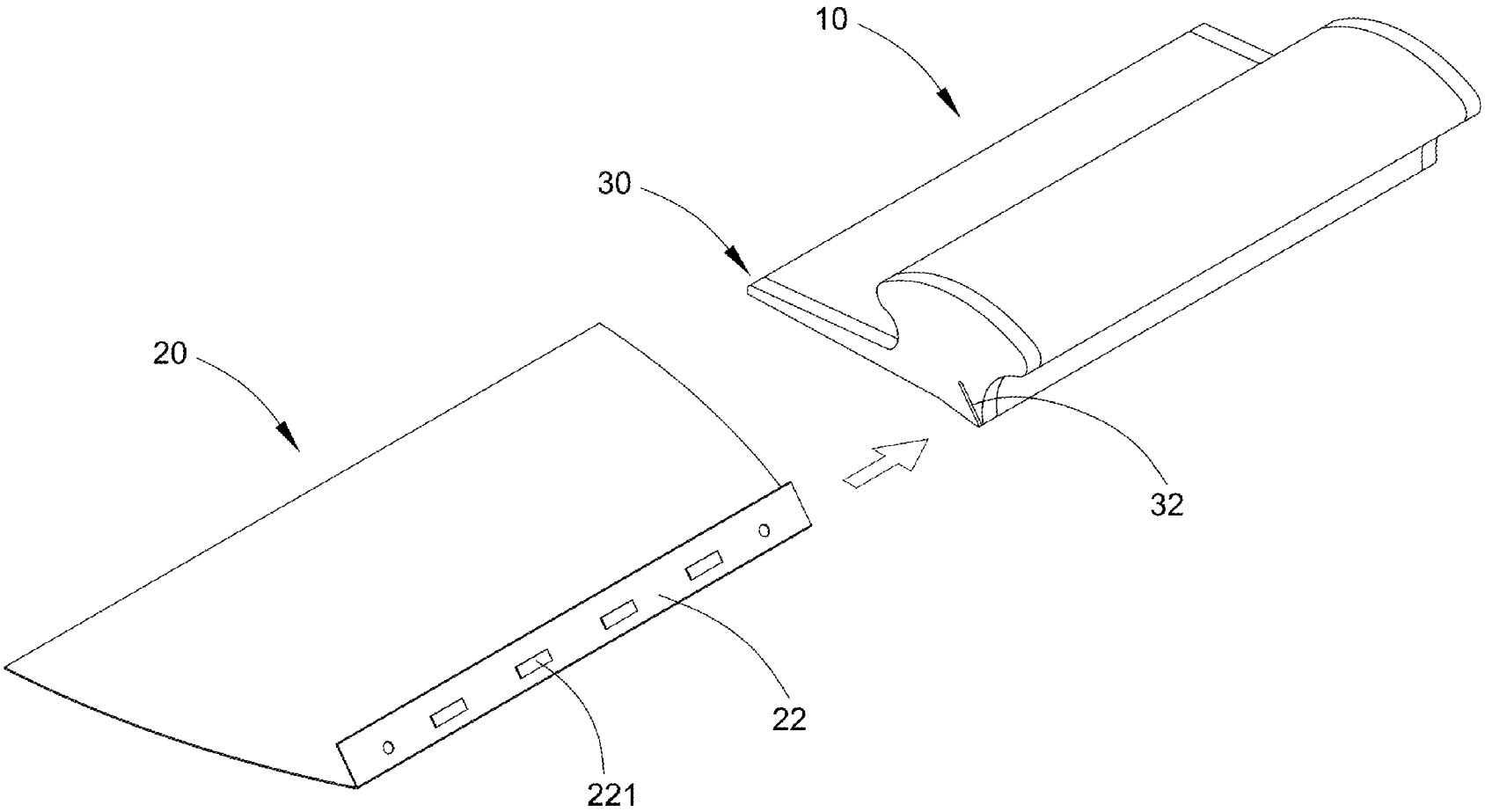
FIG. 8 illustrates assembly of the second embodiment in the present invention.

Referring to Diagram 1 to Diagram 5, these diagrams show the first embodiment of an improved painting tool structure, i.e. the present invention, which consists of a body 10, a knife board 20 and two side covers 30.

With regard to the body 10, it comprises a grip part 11 and a bottom plate 12. The grip part 11 protrudes from the upper surface on one end of the bottom plate 12, and has a circular arc surface on its top, while its top cross section is larger than the bottom cross section, thereby enabling the user to conveniently hold the body 10. Moreover, the surfaces of two sides connecting to the top and bottom sections of the grip part are of groove shape, which allows the user to grab the grip part with his/her fingers, so that the grip part 11 can be grabbed easily. A clamping slot 13 with an opening facing downward is formed between the grip part 11 and the bottom plate 12, while the opening area of the clamping slot 13 comprises a limiting body 131. The bottom plate 12 and the clamping slot 13 also form an angle, θ of less than 90 degrees. In addition, in this embodiment, the body 10 is a hollow structure, thereby saving the material cost of the body 10 and reducing its weight. Multiple fastening holes 14A, 14B and 14C, which penetrate through both ends, are formed.

The knife board 20 comprises a blade part 21 and a connecting part 22. The connecting part 22 is extended obliquely upward from one end of the blade part 21 to form an angle θ of less than 90 degrees between the blade part 21 and connecting part 22. Moreover, the angle θ between the blade part 21 and the connecting part 22 is generally equal to the angle θ between the bottom plate 12 and the clamping slot 13. In terms of design, multiple positioning parts 221 protrude from the outer surface of the connecting part 22, while each positioning part 221 is formed using impact extrusion, so that the positioning parts 221 protrude from the inner surface of the connecting part 22 toward its outer surface. The connecting part 22 is to be connected to the clamping slot 13 on the body 10, while the positioning parts 221 is used for engaging the connecting part with the limiting body 131, so that the knife board 20 is connected to the body 10. Referring to Diagram 1 and Diagram 5, after the connecting part 22 is connected to the clamping slot 13, the knife board 20 is fixed under the bottom plate 12 on the body 10, and the blade part 21 partially exposes the body 10.

With regard to the design of the body 10, an inner recess 121 can be formed on the bottom surface of the bottom plate 12. In this embodiment, the inner recess 121 is a notch formed by two inclined surfaces. The two inclined surfaces are either symmetrically or asymmetrically recessed from both ends of the bottom plate 12. Therefore, after the body 10 is connected to the knife board 20, the inner recess 121 is designed such that the blade part 21 is only in contact with both ends of the bottom plate 12 that the central portion will form a gap without any contact, thereby effectively preventing the upper surface of the blade part 21 and the bottom surface of the bottom plate 12 from absorbing each other (in vacuum state) while both surfaces are in close contact as such a situation leads to inconvenience during disassembly.

The two side covers 30 are to be connected to the surface on both ends of the body 10, where the body 10 comprises multiple fastening holes 14A, 14B and 14C. The two side covers 30 comprise multiple positioning bodies 31A, 31B and 31C, where positioning bodies 31A, 31B and 31C can extend through fastening holes 14A, 14B and 14C, respectively, such that positioning bodies 31A, 31B and 31C are complementary to fastening holes 14A, 14B and 14C, respectively; or such that positioning bodies 31A, 31B and 31C can be attached to the inner circumferential surface of fastening holes 14A, 14B and 14C, respectively, thereby connecting the two side covers 30 to the surface on both ends of the body 10.

To be more detailed, the connecting part 22 has a long strip shape, while the positioning part 22 is generally rectangular in shape after impact extrusion, and its top end is connected to the connecting part 22. The two sides and the bottom end are separated from the connecting part due to impact extrusion, and the bottom end protrudes toward the outer surface of the connecting part 22. In other words, after the connecting part 22 is connected to the clamping slot 13, the positioning part 22 can be engaged with the limiting body 131 on the clamping slot 13 through the design of protrusion from the bottom edge, such that the knife board 10 is fixed to the body 10. In this embodiment, the positioning part 22 and the limiting body 131 are designed using one of many engagement methods, and can be fixed using different methods.

Referring to Diagram 6, when the knife board 20 needs to be replaced, only the side cover 30 on one end of the body 10 needs to be removed. The knife board 20 can be moved laterally to the body 10 in order to remove the knife board 20 smoothly, so that the other knife board 20 can be inserted into the clamping slot on the body 10 from the connecting part 22. This way, the knife board 20 can be easily replaced without the aid of any tools, thereby highlighting its advantage and efficiency to replace easily and conveniently.

Referring to Diagram 7 and Diagram 8 which show the second embodiment of the present invention, its characteristics are as follows: At least one side cover 30 is provided with a guiding slot 32, which is disposed at the bottom edge of the side cover 30, and corresponds to the clamping slot 13 on the body 10. Therefore, the user can directly insert the connecting part 22 on the knife board 20 into the clamping slot 13 from the guiding slot 32 without having to remove the side cover 30, so that the body 10 and the knife board 20 are connected to each other.

In addition, it is worth mentioning that the design of the positioning part 221 in the second embodiment through impact extrusion is slightly different from that in the first embodiment. The positioning part 221 is generally rectangular in shape after impact extrusion, but its top and bottom ends and one of its sides are separated from the connecting part 22, while the other side is connected to the connecting part 22. The separated side protrudes toward the connecting part 22, and faces the side cover comprising the guiding slot 32. Therefore, the positioning part 221 can result frictional resistance with the inner surface of the clamping slot 13 using the protruding side, thereby preventing the knife board 20 from moving toward the guiding slot 32. When the knife board 20 needs to be replaced, only the side cover 30 without the guiding slot 32 on the body 10 needs to be removed. The knife board 20 is moved laterally to the body 10 in order to remove the knife board 20 smoothly.

The above is merely a detailed description of the present invention using the preferred embodiments. Any simple modifications or changes made to the embodiments will not deviate from the spirit and scope of the present invention.

The detailed description above enables those who are skilled in this art to understand that the present invention can achieve the afore-mentioned purpose. As it has already complied with the provisions of the Patent Act, we would like to file a patent application for the present invention.

What is claimed is:

1. An improved painting tool structure comprising:

a body, the body comprising a grip portion and a bottom plate, the grip portion protruding from an upper surface on an end of the bottom plate, while a clamping slot with an opening facing downward is formed between the grip portion and the bottom plate, a limiting body disposed in the clamping slot, the bottom plate and the clamping slot forming an angle of less than 90 degrees;

a knife board comprising a blade portion and a connecting portion, the connecting portion extending obliquely upward from one end of the blade portion to form an angle of less than 90 degrees with the blade portion, and the angle between the blade portion and the connecting portion is generally equal to the angle between the bottom plate and the clamping slot, the connecting portion comprising multiple positioning portions, the connecting portion configured to connect to the clamping slot on the body, the positioning portions configured to engage the limiting body so that the knife board is connected to the body;

wherein when the connecting portion is connected to the clamping slot, the knife board is fixed under the bottom plate of the body, and the blade portion partially exposes the body.

2. An improved painting tool structure as claimed in claim 1, wherein a top of the grip portion has a circular arc surface, and a surface on two sides connecting to top and bottom sections of the grip portion form a groove.

3. An improved painting tool structure as claimed in claim 1, wherein the body is a hollow structure formed with multiple fastening holes penetrating opposite ends of the body.

4. An improved painting tool structure as claimed in claim 1, wherein an inner recess is defined on a bottom surface of the bottom plate, the inner recess comprising a notch formed between two ends of the bottom plate.

5. An improved painting tool structure as claimed in claim 1, wherein the positioning portions protrude from an outer surface of the connection portion.

6. An improved painting tool structure as claimed in claim 1, further comprising two side covers respectively connected to opposing ends of the body.

7. An improved painting tool structure as claimed in claim 6, wherein the body comprises multiple fastening holes, and the two side covers comprise multiple positioning bodies, and each positioning body is complementary to one of the fastening holes.

8. An improved painting tool structure as claimed in claim 6, wherein the body comprises multiple fastening holes, the two side covers comprise multiple positioning bodies, and each positioning body is attached to an inner circumferential surface of one of the fastening holes to connect the two side covers to the opposing ends of the body.

9. An improved painting tool structure as claimed in claim 6, wherein at least one side cover comprises a guiding slot disposed at a bottom edge of the side cover and corresponds to the clamping slot on the body.

* * * * *